United States Patent [19]

Senger

[11] 3,973,989

[45] Aug. 10, 1976

[54] CLEANING MACHINE FOR METAL PARTS

[76] Inventor: Egon Senger, Hansastrasse 51, Rheine, Germany

[22] Filed: Feb. 7, 1975

[21] Appl. No.: 548,036

[52] U.S. Cl. ..... 134/141; 134/112; 134/138; 134/154; 239/237

[51] Int. Cl.[2] ..... B08B 3/02

[58] Field of Search ..... 134/56 R, 56 D, 112, 134/138, 139, 141, 183, 154; 239/237

[56] References Cited

UNITED STATES PATENTS

| | | | |
|---|---|---|---|
| 1,633,803 | 6/1927 | Ballin | 134/138 |
| 1,637,376 | 8/1927 | Gibney | 134/112 X |
| 1,710,107 | 4/1929 | Orr | 239/237 X |
| 2,517,109 | 8/1950 | Hollerith | 134/56 D |
| 2,567,820 | 9/1951 | Messerschmidt | 134/138 |
| 3,656,491 | 4/1972 | Ballard | 134/139 X |

*Primary Examiner*—Robert L. Bieutge
*Attorney, Agent, or Firm*—Marshall & Yeasting

[57] ABSTRACT

A cleaning machine for cleaning dirty, greasy or otherwise polluted metal parts comprises a foraminated basket for receiving said metal parts, which basket is rigidly mounted for rotation with a rotatable wheel. The wheel is driven by spray jets from spray nozzles around the periphery of the wheel. The spokes of said wheel have their free ends provided with vanes mounted thereon in a freely swingable position. Within certain limits of the rotation speed of the rotor the vanes are hit by the spray jets. If a specific speed is exceeded, the vanes are swung outwards by centrifugal forces and brought beyond the effective operation area of the spray jets. In the absence of a driving force the rotation speed will go down. In this way an automatic controlling of the rotation speed is possible.

5 Claims, 3 Drawing Figures

CLEANING MACHINE FOR METAL PARTS

BACKGROUND OF THE INVENTION

The present invention relates to a cleaning machine for metal parts comprising a basket, grate or similar foraminated container for receiving the metal parts, rigidly mounted for rotation on a rotating wheel or rotor, the driving of which is effected by means of one or more jet nozzles acting on said wheel or rotor, through which nozzles a fluid under pressure is passed, and means for maintaining constant the rotation speed of said wheel.

In the art of metal processing and in particular in workshops for repair and maintenance, service-stations or garages, cleaning machines for cleaning metal parts are known fulfilling the task of a washing machine, that is to say to clean metal parts from adhering soil, dirt, grease, fat or other pollution. Within the machine is provided a basket, grate or similar metal parts receiving foraminated container, resting on a rotating wheel, which is driven into rotation. In the machines thusfar known the rotating wheel is driven by means of the jet from a spray nozzle acting on the spokes of the rotating wheel to the effect that the wheel starts rotating.

In machines of simple construction the speed of the rotating wheel is controlled manually by means of a simple handle and monitored visually, said handle being operated when-ever an inspection of the speed indicator shows that the actual speed deviates from the normal value. In the event that the speed is too low the pressure of the fluid leaving the nozzle is increased, and in the opposite case the pressure is reduced.

There have also been known machines, in which the rotating wheel can be driven by two pressurized spray nozzles, either in a clock-wise or anti-clockwise direction. The rotation direction and rotation speed required can be controlled continuously via a manually operated differential valve, the rotation speed and rotation direction being clearly indicated on a corresponding instrument. In this known construction the fluid pressure is transferred differentially to both spray nozzles by the intermediary of the differential valve permitting a limitation of the rotation speed.

However, this known device still requires a careful adjustment of the spray pressures by means of the differential valve, so that a convenient operation of the machine depends on the carefulness of the operator. It must be ensured that in any circumstance, depending on the loading weight of the metal parts to be cleaned, carried by the rotation wheel, the fluid pressure needed can be achieved so as to drive the rotating wheel at the rotation speed desired. It should be noted that if this rotation speed increases, there is a risk that due to centrifugal forces metal parts will be flung out of the grate, which may result in damaging of the machine.

It is desirable in machines of this type that the grate proper have a constant rotation speed of say 30 revolutions per minute, permitting on the one hand a satisfactory cleaning effect, and on the other hand a positioning, without danger, of the metal parts.

SUMMARY OF THE INVENTION

The present invention has for its object to facilitate the operation of the machine which so far required much attention, yet allowing utilisation of the fluid nozzle as a simple driving means.

Correspondingly the invention provides for a cleaning machine for metal parts comprising a basket, grate or similar foraminated container for receiving said metal parts, rigidly mounted for rotation on a rotating wheel or rotor, the driving of which is effected by means of one or more jet nozzles acting on said wheel or rotor, through which nozzles a fluid under pressure is passed, and means for maintaining constant the rotation speed of said rotating wheel, said machine being characterized by vanes freely pivotable about pins mounted in bearings at the free extremities of the spokes of the rotating wheel and perpendicular to the longitudinal axis of the spokes.

By the means of the invention the driving mechanism is rendered directly reactive to centrifugal forces due to the presence of vanes along its circumference. These depending vanes are freely swingable and are subjected to the full effect of the nozzle jet within a range of the rotation speed from zero up to a certain desirable rotation speed. At higher speeds, however, the vanes will swing outwards under centrifugal forces, and move out of the path of the spray jet. In this way the rotation speed of the wheel is automatically limited.

According to the invention it is further arranged that the vanes taper outwards from their bearing to their free extremity, so that continuous controlling of the rotation speed is possible, said controlling preferably being combined with the feature that the direction of the jet of the spray nozzle is adjustable.

The vanes can have their lower free extremity provided with an additional weight which according to a further aspect of the invention is adjustable. In this way the machine operator has another possibility to set the rotation speed to a desired magnitude.

DESCRIPTION OF THE PREFERRED EMBODIMENT

Figure 1:
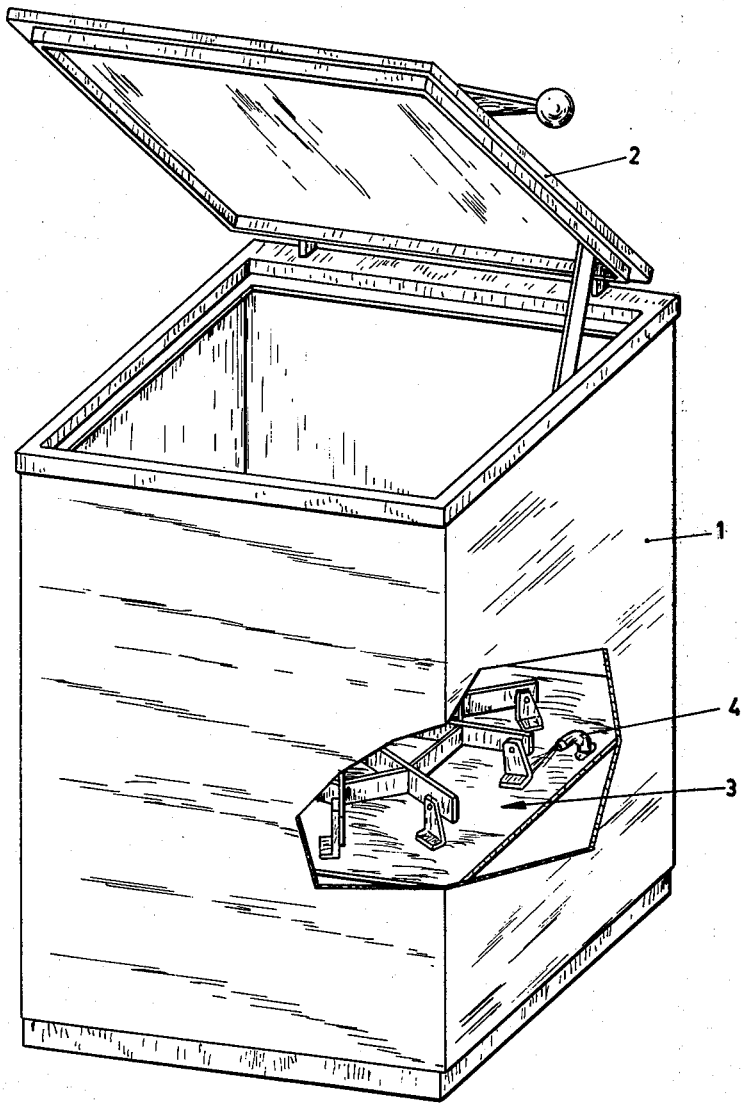
FIG. 1 is a perspective view of a cleaning machine for metal parts.
Figure 2:
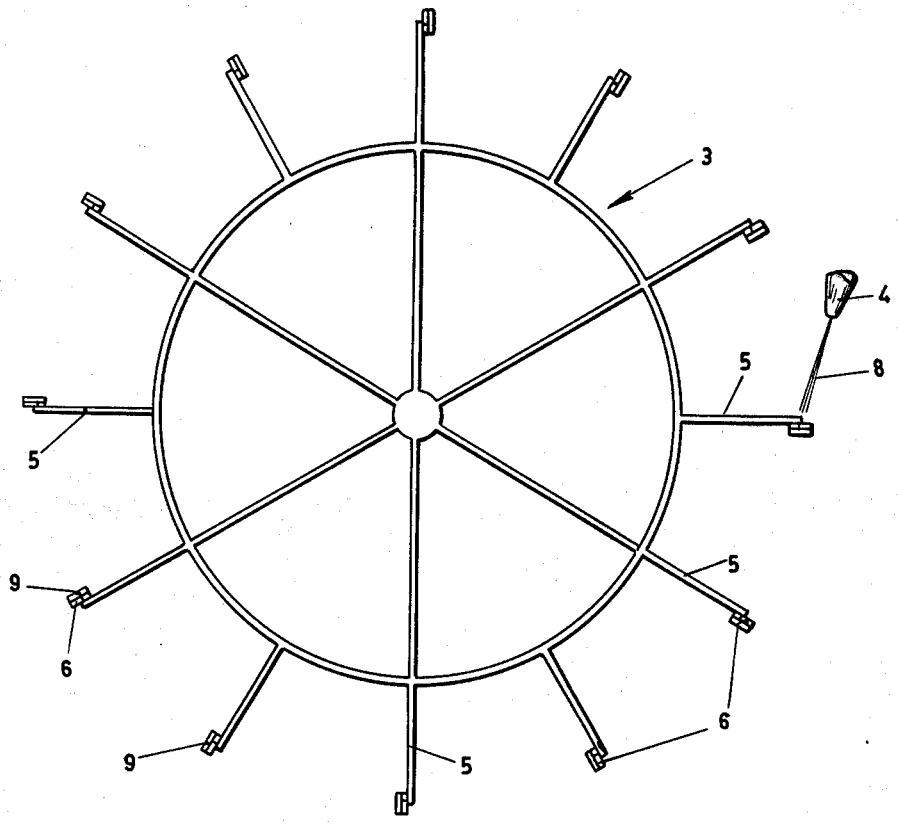
FIG. 2 is a plan view of the rotation wheel for driving the machine.

In FIG. 1 is indicated at 1 the casing of a cleaning machine for metal parts, said casing being accessible for instance through a cover or lid 2 on top of the machine. The machine can of course be provided with a front door so that loading of the machine can be done in a frontal direction. The machine described sofar does not depart from the constructions hitherto commercially available and known in the art. Within the machine are provided the necessary heating means, spray means etc., which for the sake of clarity have not been represented in the drawing.

As can be seen in FIG. 1, parts of the casing of the machine 1 have been broken away to show a rotation wheel 3 mounted in the lower part of the machine, on which wheel a grate, basket or similar foraminated container, not shown, can be secured for receiving the metal parts to be cleaned. The driving of the rotation wheel 3 is effected by the fluid jet from a spray nozzle 4, it being understood that various other spray nozzles can be arranged, being distributed along the circumference of the rotation wheel 3.

Figure 3:
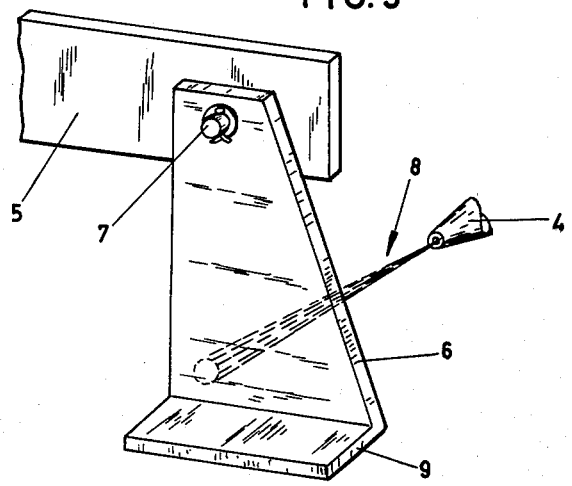
FIG. 3 is a perspective view on a fragmentary larger scale, showing the construction of the vanes.

At the end of the individual spokes 5 of the rotation wheel 3 are provided, as best shown in FIG. 3, separate vanes 6, freely swingable about a pin 7 at the end of the spokes 5. The pins 7 are perpendicular to the longitudinal axis of the spokes. In this way the vanes 6 can swing in the plane of the longitudinal axes of the spokes 5 and will therefore, at a specific speed, pivot outwardly about the pins 7 due to centrifugal forces. In their initial position the vanes are hanging downwards in the effective operation range of the spray jet 8 delivered by the spray nozzle 4 so that due to the reaction force a revolution of the rotation wheel will follow.

It will be appreciated that at a certain rotation speed the vanes will swing out of the operation zone of the spray jet 8, so that the rotation speed of the rotation wheel is correspondingly reduced and the rotation speed can be kept constant.

In the embodiment shown the vanes are diverging from their bearing on the pin 7 in a downward direction. On their lower end they have a bent portion 9, the size of which defines the weight of the vanes and thus the time at which the vanes will swing outwards due to centrifugal forces. The size of these folded portions 9 can easily be adjusted in metal processing plants with the aid of usual available tools. The reaction weight of the vanes can be adjusted by applying additional weight units for instance by welding.

While heretofore a careful attentive operation of the machine was imperative to ensure the required rotation speed which influences on the one hand the cleaning effect, and on the other hand the reliability of the machine, the machine equipped with the present construction operates completely automatically with respect to maintaining constant the rotation speed, thus causing a considerable saving in operation costs. The fluid used in the machine according to the invention is water with some detergent. In certain circumstances it is also feasible to use air as the driving fluid. In that case the metal parts may be contained in a non-foraminated basket filled with a stronger mixture of water and detergent. After some time a valve is opened so that the polluted mixture can be drained off and replaced by a fresh mixture or by water alone to rinse the metal parts.

I claim:

1. A cleaning machine for metal parts, comprising a basket for holding the metal parts while they are contacted by a detergent liquid, a support for said basket, which support is rotatably mounted on a vertical axis, and at least one jet nozzle arranged to discharge a jet of fluid for rotating said support, wherein the improvement comprises a plurality of freely swingable vanes depending from said support, said vanes in their normal hanging positions being arranged to enter successively said jet of fluid so as to serve as inmpellers to rotate said support, and being pivoted to said support on axis which are generally tangential, whereby the action of centrifugal force on said vanes causes them to swing upward out of the path of said jet to limit the speed of rotation of said support.

2. A cleaning machine as claimed in claim 1, characterized in that the vanes are tapered outwards from their pivots to their free extremity.

3. A cleaning machine according to claim 1, characterized in that the vanes carry on their lower free ends an additional weight.

4. A cleaning machine as claimed in claim 3, characterized in that the weight is adjustable.

5. A cleaning machine as claimed in claim 1, characterized in that the direction of the jet of the spray mozzle is adjustable.

* * * * *